US007791609B2

(12) United States Patent
Lee

(10) Patent No.: US 7,791,609 B2
(45) Date of Patent: Sep. 7, 2010

(54) APPARATUS AND METHOD PROVIDING AUTOMATIC DISPLAY CONTROL IN A MULTIMEDIA SYSTEM

(75) Inventor: Yong-jai Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 322 days.

(21) Appl. No.: 10/896,937

(22) Filed: Jul. 23, 2004

(65) Prior Publication Data

US 2005/0024392 A1 Feb. 3, 2005

(30) Foreign Application Priority Data

Jul. 29, 2003 (KR) ..... 10-2003-0052448

(51) Int. Cl.
*G09G 5/39* (2006.01)

(52) U.S. Cl. ..... 345/531; 345/537; 345/538; 345/548

(58) Field of Classification Search ..... 345/531, 345/537, 538, 548
See application file for complete search history.

(56) References Cited

U.S. PATENT DOCUMENTS 5,031,118 A * 7/1991 Morizot ..... 345/698
5,375,210 A * 12/1994 Monnes et al. ..... 710/10
5,483,260 A * 1/1996 Parks et al. ..... 345/156
5,561,764 A * 10/1996 Ninomiya ..... 714/37
5,579,029 A 11/1996 Arai
5,682,529 A * 10/1997 Hendry et al. ..... 713/100
5,710,570 A * 1/1998 Wada et al. ..... 345/3.2
5,801,767 A * 9/1998 Wu ..... 348/190
5,943,029 A * 8/1999 Ross ..... 345/11
6,043,814 A * 3/2000 Lim ..... 715/700
6,049,316 A * 4/2000 Nolan et al. ..... 345/698
6,052,740 A * 4/2000 Frederick ..... 710/8

(Continued)

FOREIGN PATENT DOCUMENTS

JP 6-93279 3/1994

(Continued)

OTHER PUBLICATIONS

Korean Official Action issued on Jul. 26, 2005, for Korean Patent Application No. 2003-52448.

*Primary Examiner*—Ulka Chauhan
*Assistant Examiner*—Daniel Washburn
(74) *Attorney, Agent, or Firm*—Stanzione & Kim, LLP

(57) ABSTRACT

An apparatus and a method providing an automatic display control in a multimedia system. The apparatus includes a memory that stores predetermined display information; a controller that includes a communication module to perform data communication with an external device, set to be in a master mode to write the display information to the memory in an initialize mode and set to be in a slave mode to analyze display control data for a predetermined automatic display control function which is transmitted by the external device, in other modes, and generates a display control signal used to perform a function that corresponds to the result of analyzing the display control data; and a video signal processor that receives video signals from the external device, converts the format of the video signals to another format suitable for the display characteristics of a display means, and processes the converted video signals according to the control signal.

17 Claims, 4 Drawing Sheets

U.S. PATENT DOCUMENTS

| | | | | |
|---|---|---|---|---|
| 6,115,026 | A * | 9/2000 | Spurlock | 345/24 |
| 6,243,059 | B1 * | 6/2001 | Greene et al. | 345/88 |
| 6,262,765 | B1 * | 7/2001 | Jeong | 348/180 |
| 6,282,646 | B1 * | 8/2001 | Hendry et al. | 713/100 |
| 6,314,479 | B1 * | 11/2001 | Frederick et al. | 710/63 |
| 6,326,935 | B1 * | 12/2001 | Boger | 345/3.2 |
| 6,552,738 | B1 * | 4/2003 | Lin et al. | 715/810 |
| 6,559,826 | B1 * | 5/2003 | Mendelson et al. | 345/102 |
| 6,600,747 | B1 * | 7/2003 | Sauber | 370/395.64 |
| 6,611,249 | B1 * | 8/2003 | Evanicky et al. | 345/102 |
| 6,741,240 | B1 * | 5/2004 | Akaiwa et al. | 345/213 |
| 6,839,055 | B1 * | 1/2005 | Nguyen | 345/204 |
| 6,873,307 | B2 * | 3/2005 | Nitta et al. | 345/3.1 |
| 7,117,283 | B2 * | 10/2006 | Trembley | 710/110 |
| 2003/0122843 | A1 * | 7/2003 | Lai et al. | 345/589 |
| 2003/0156116 | A1 * | 8/2003 | Hamon | 345/531 |
| 2004/0039927 | A1 * | 2/2004 | Hazama et al. | 713/189 |

FOREIGN PATENT DOCUMENTS

| | | |
|---|---|---|
| JP | 09-134153 | 5/1997 |
| KR | 1999-0080023 | 11/1999 |
| KR | 2000-0030920 | 6/2000 |
| KR | 2002-74347 | 3/2001 |
| KR | 2002-93377 | 6/2001 |
| KR | 2004-0040831 | 5/2004 |

* cited by examiner

APPARATUS AND METHOD PROVIDING AUTOMATIC DISPLAY CONTROL IN A MULTIMEDIA SYSTEM

CROSS-REFERENCE TO RELATED APPLICATIONS

This application claims the benefit of Korean Patent Application No. 2003-52448, filed on Jul. 29, 2003 in the Korean Intellectual Property Office, the disclosure of which is incorporated herein in its entirety.

BACKGROUND OF THE INVENTION

1. Field of the Invention

The present invention relates to an apparatus and method providing display control in a multimedia system, and more particularly, to an apparatus and method providing automatic display control in a multimedia system, which adaptively controls display features of a monitor in response to the display settings of a computer.

2. Description of the Related Art

Generally, a monitor is a display device that displays video signals received from a signal source such as a computer. Recently, Plug and Play monitors have become widely available due to the convenience they offer users. The term Plug and Play (PnP) means, for example, a function of providing an optimum configuration for a computer by automatically re-configuring a user's environment as soon as a new board or a peripheral device is plugged into, connected to, or installed in the computer, thereby allowing a user to immediately use the new installed device without the need to manually match up the device with its driver in the computer.

A PnP monitor, which is capable of exchanging information with a computer, is supposed to communicate with computer information about functions it supports and various monitor adjustment status, while a conventional monitor just receives and displays signals from the computer.

Accordingly, in order to apply PnP to the conventional monitor, the monitor should be able to store its own information and be equipped with a communication protocol to transmit the information to the computer.

As for the communication protocol, a Display Data Channel (DDC) standard for PnP monitors was created by Video Electronics Standard Association (VESA), which is a non-profit company managed by companies of computer peripheral devices in the United States. The DDC standard defines a communication channel between a computer and a monitor, i.e., a protocol that allows the monitor to transmit monitor information to the computer.

However, conventional PnP monitors only transmit basic monitor information via a cable to a video card installed in a computer, but do not receive any control information from the computer, resulting in problems in that PnP monitors connected to computers cannot optimize their display settings in response to changes in the display conditions of the computer.

SUMMARY OF THE INVENTION

The present general inventive concept provides an apparatus and method providing automatic display control in a multimedia system, in which a computer directly controls a monitor so that display settings of the monitor are automatically optimized in response to changes in display conditions of a computer.

Additional aspects and advantages of the present general inventive concept will be set forth in part in the description which follows and, in part, will be obvious from the description, or may be learned by practice of the general inventive concept.

The foregoing and/or other aspects of the present general inventive concept are achieved by providing a display device providing automatic display control, the display device including a memory that stores predetermined display information, a controller that includes a communication module to perform data communication with an external device, set to be in a master mode to write the display information to the memory in an initialize mode and set to be in a slave mode to analyze display control data for a predetermined automatic display control function which is transmitted by the external device, in other modes, and generates a display control signal used to perform a function that corresponds to the result of analyzing the display control data; and a video signal processor that receives video signals from the external device, converts the format of the video signals to another format suitable for the display characteristics of a display means, and processes the converted video signals according to the control signal.

The communication module may include hardware and software to implement a display data channel (DDC) transmission standard.

The display information may include display feature information and slave address information of the communication module.

The initialize mode may be a mode in which the display device is booted for the first time since the display device has been manufactured.

The predetermined automatic display control function may include an automatic magic bright display function.

The foregoing and/or other aspects of the present general inventive concept may also be achieved by providing a multimedia system providing automatic display control, the multimedia system including a computer which includes a communication module providing data communication with an external device, a video card, and software and hardware that drives the video card, reads display information from the external device according to a predetermined communication protocol, generates data in connection with an automatic display control function and transmits the data to the external device via the communication module; and a display device which includes a communication module providing data communication with the computer, is set to be in a master mode to write display information in a memory during an initialize mode and set to be in a slave mode to analyze the data in connection with the automatic display control function that is transmitted by the computer, in other modes, and performs signal processing in response to the result obtained by analyzing the data in connection with the automatic display control function and outputs the processed signal.

The display device may include a memory which stores predetermined display information; a controller which includes a communication module that provides data communication with an external device, is set to be in a master mode to write the display information in the memory during the initialize mode and set to be in a slave mode to analyze data transmitted by the external device in connection with the automatic display control function, during other modes, and generates a display control signal to perform a function that is adaptable to the analyzed result; and a video signal processor which receives video signals from the external device, converts a format of the video signals to a format suitable for the display characteristics and processes the converted video signals according to the display control signal.

The communication module may include hardware and software to implement a display data channel (DDC) transmission standard.

The predetermined automatic display control function may include an automatic magic bright display function.

The foregoing and/or other aspects of the general inventive concept may also be achieved by providing an automatic display control method implemented in a display device of a multimedia system, the method including determining whether the display device is in an initialize mode; if the display device is in an initialize mode, setting a display controller to be in a master mode; determining whether predetermined display information is stored in a monitor memory; and if the predetermined display information is stored in the monitor memory, setting the monitor controller to be in a slave mode, and otherwise, setting the monitor controller to be in the slave mode after writing display information to the monitor memory.

The initialize mode may be a mode in which the display device is booted for the first time since the display device has been manufactured.

The display information may include monitor feature information and slave address information of a communication module.

The foregoing and/or other aspects of the general inventive concept may also be achieved by providing an automatic display control method that can be implemented in a computer of a multimedia system, the method including determining whether a video card installed in the computer is electrically connected to a monitor; if the video card is electrically connected to the monitor, receiving predetermined display information from the monitor according to a predetermined communication protocol; detecting a condition that causes a function of predetermined automatic display control; and if the condition is detected, generating monitor control data, which is adapted to the function of the predetermined automatic display control, and transmitting the data to the monitor according to the predetermined communication protocol.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
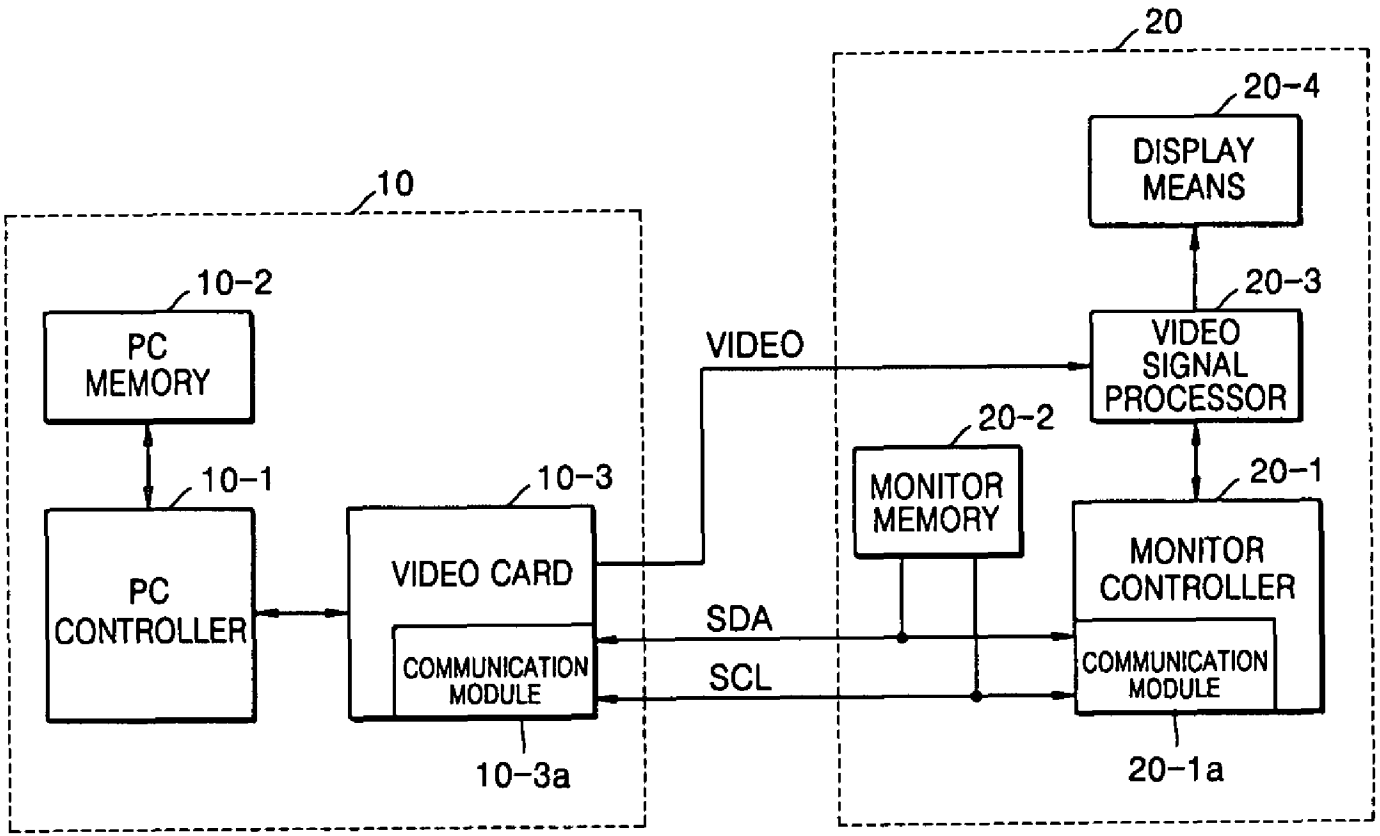
FIG. 1 is a schematic diagram of a multimedia system providing automatic display control according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a schematic diagram of a multimedia system that provides an automatic display control according to an embodiment of the present general inventive concept. In FIG. 1, the multimedia system includes a computer 10 and a monitor 20.

The computer 10 may include a PC controller 10-1, PC memory 10-2 and a video card 10-3 with a communication module 10-3*a*.

The monitor 20 may include a monitor controller 20-1 with a communication module 20-1*a*, a monitor memory 20-2, a video signal processor 20-3 and a display means 204.

The communication modules 10-3*a* and 20-1*a* can employ, for example, a display data channel (DDC) transmission scheme, and in this case, a clock line SCL and a data line (SDA) are used to provide communication between the communication modules 10-3*a* and 20-1*a*.

First, operations of the computer 10 are described.

The PC memory 10-2 can store data and various programs used to control the computer, and especially, programs used to drive the video card 10-3. In addition, the PC memory 10-2 can store programs used to realize a method of automatic display control in the multimedia system according to an embodiment of the present general inventive concept, which will be described with reference to FIG. 3 through FIG. 5.

The PC controller 10-1 uses the various programs that are stored in the PC memory 10-2 to control the various components in the computer, and, in particular, performs a control process that provides automatic display control according to an embodiment of the present general inventive concept. In other words, when the video card 10-3 is electrically connected to the monitor 20, the PC controller 10-1 reads monitor information from the monitor memory 20-2 according to the DDC communication protocol and optimizes the settings of the video card 10-3 with respect to the monitor information. During video data processing in the video card 10-3, if a condition that causes a function of the automatic display control is detected, the PC controller 10-1 generates data for the automatic display control and then controls the data to be transmitted to the monitor controller 20-1 via the communication module 10-3*a*.

The video card 10-3 includes the communication module 10-3*a* providing data communication with the monitor 20, and hardware and/or software that encodes/decodes video data and converts the video format, for example, the resolution, of the video data to adapt to the optimized display features.

Next, operations of the monitor 20 are described.

The monitor controller 20-1 that controls the overall operation of the monitor also performs data communication with the computer 10 using a communication module 20-1*a* within the monitor controller 20-1. The monitor controller 20-1 is set to be in a master mode during a time in which it writes monitor information to the monitor memory 20-2 in an initialize mode, and set to be in a slave mode during a time in which it analyzes data for the automatic (display) control, which is transmitted by the video card 10-3 of the computer 10, and generates a display control signal to perform a function that is adapted for the analyzed result.

The monitor memory 20-2 can store a model name of the monitor, monitor information including monitor feature information such as resolutions supported by the monitor and/or recommended by the manufacturer, and slave address information of the communication module 20-1*a*. The monitor memory 20-2 also can store various programs and data to control the monitor.

The video signal processor 20-3 can convert the scale format of video signals received from the video card 10-3 to adapt to the display characteristics of the display means 204, and can perform signal processing to vary video signal properties such as brightness, luminance, and chromaticity in response to the display control signals generated by the monitor controller 20-1 in connection with the function of the automatic display control.

The display means 20-4 can be realized as a digital display, such as a liquid crystal display (LCD) and a plasma display panel (PDP), or an analog display, such as a cathode-ray tube (CRT).

The method of automatic display control in a multimedia system will now be described with reference to FIG. 2 through FIG. 5.

Figure 2:
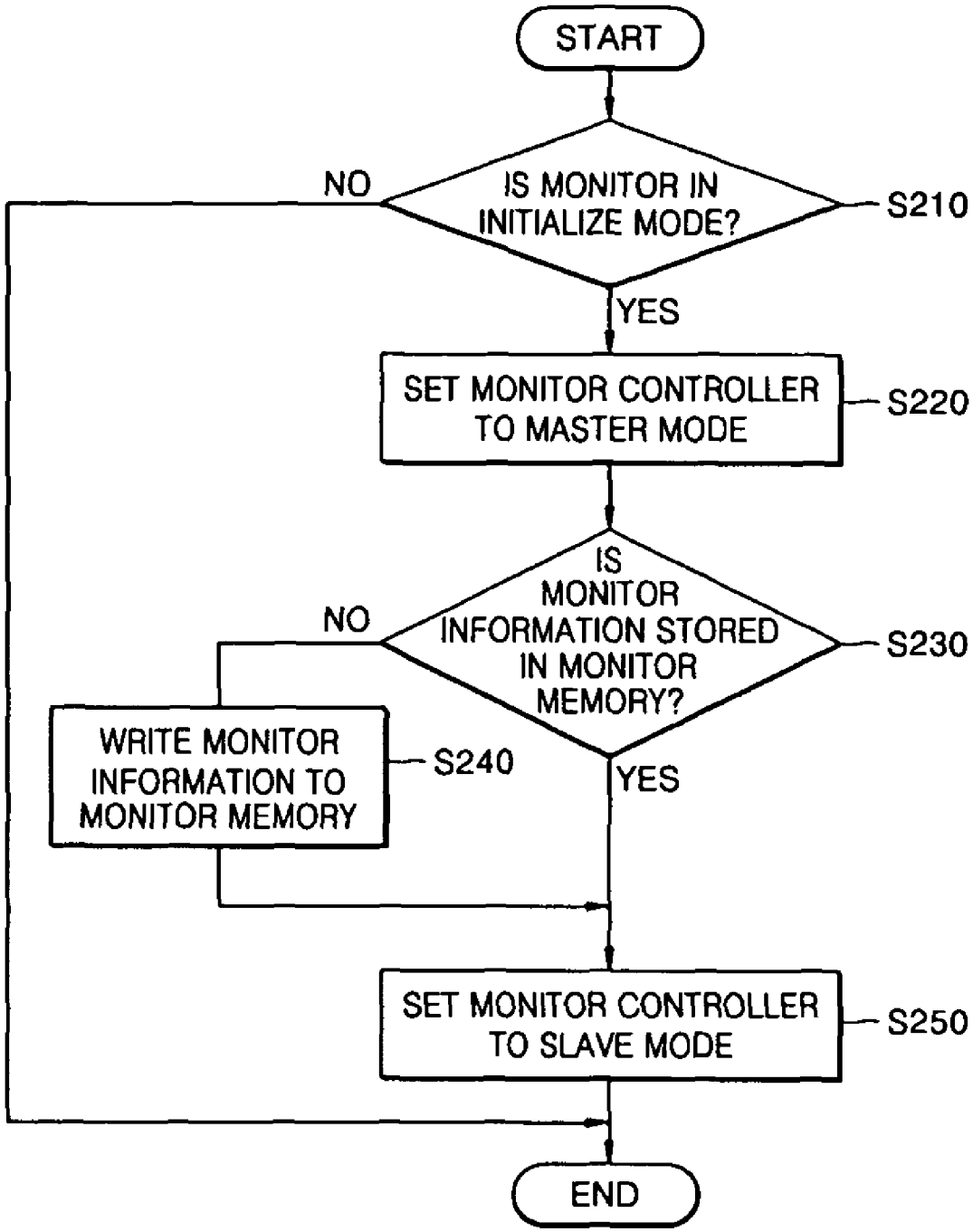
FIG. 2 is a flowchart of automatic display control performed by a monitor in a multimedia system.

First, the method of automatic display control that is performed by a monitor in the multimedia system is described with reference to FIG. 2.

The monitor controller 20-1 determines whether the display means 20-4 is in an initialize mode in operation S210. The initialize mode corresponds to a mode in which the monitor is booted for the first time since the monitor has been manufactured.

If the display means 20-4 is in the initialize mode in operation S210, the monitor controller 20-1 enters a master mode in operation S220. In the master mode, the monitor controller 20-1 determines whether the monitor memory 20-2 stores monitor information in operation S230. The monitor information can include a model name of the monitor, monitor display characteristics, such as resolution that is supported by the monitor and/or recommended by the manufacturer, and slave address information of the communication module 20-1*a* in the monitor controller 20-1.

If there is monitor information in the monitor memory 20-2 in operation S230, the monitor controller 20-1 is set to be in a slave mode in operation S250. Otherwise, the monitor controller 20-1 writes monitor information to the monitor memory 20-2 in operation S240, and then is set to the slave mode in operation S250.

When the monitor controller 20-1 is set to the slave mode in operation S250, it receives various data or monitor control conditions for an automatic display control from the video card 10-3. The monitor controller 20-1 is set to the master mode to vary the monitor control conditions to adapt to the conditions that are provided by the video card 10-3 of the computer 10.

Figure 3:
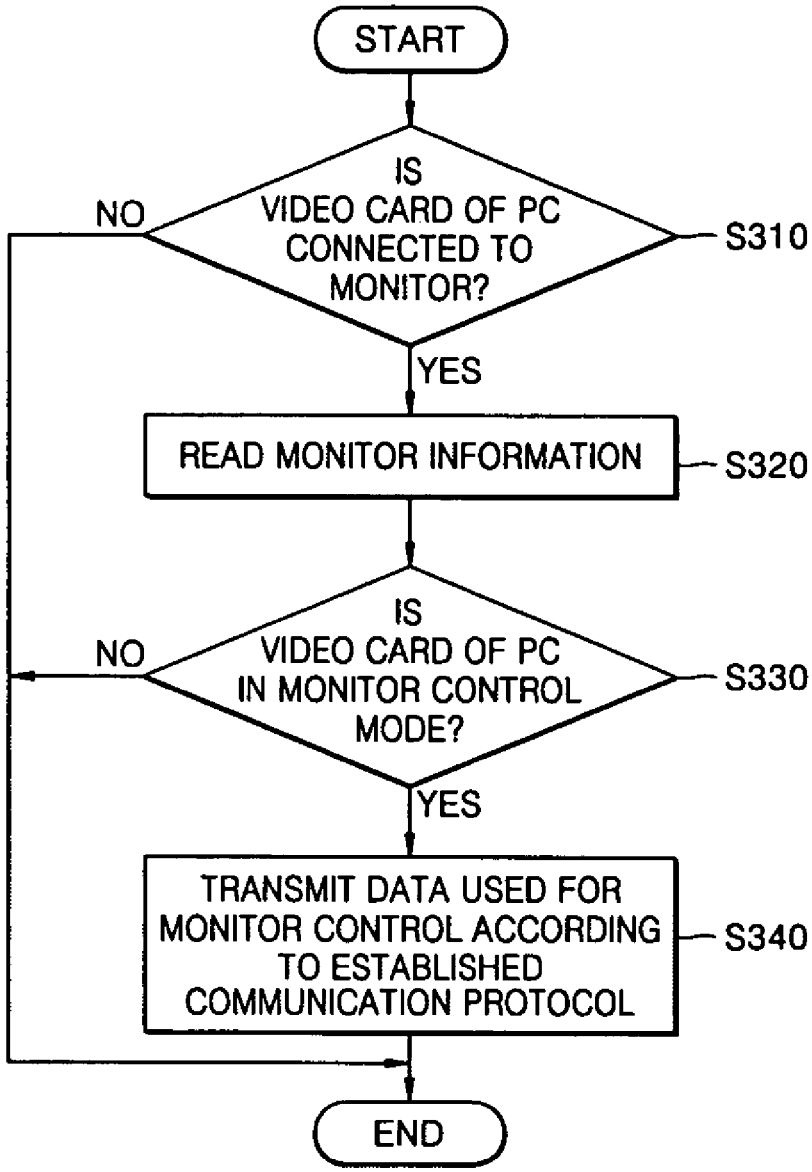
FIG. 3 is a flowchart of automatic display control performed by a computer in a multimedia system.

Next, the method of automatic display control that is performed by a computer in a multimedia system is described with reference to FIG. 3.

The PC controller 10-1 determines whether the video card 10-3 is electrically connected to the monitor 20 in operation S310. In other words, the PC controller 10-1 determines whether the communication module 10-3*a* of the video card 10-3 is electrically connected with the communication module 20-1*a* of the monitor controller 20-1.

If the video card 10-3 is determined to be electrically connected to the monitor 20, the PC controller 10-1 reads monitor information from the monitor memory 20-2 and optimizes the settings of the video card 10-3 to adapt to the monitor information in operation S320. As previously mentioned, the monitor information can include a model name of the monitor, monitor display characteristics such as resolution that is supported by the monitor and/or recommended by the manufacturer, and slave address information of the communication module 20-1*a*.

In operation S330, during the process of video data output by the video card 10-3, the PC controller 10-1 determines whether a monitor control mode that corresponds to a condition that causes a function of the automatic display control is detected. An automatic magic bright function is an example of the function of the automatic display control.

When the monitor control mode is detected in operation S330, the PC controller 10-1 controls the video card 10-3 to transmit data that controls the monitor to the monitor controller 20-1, which is in the slave mode, according to DDC communication protocol, in operation S340.

Accordingly, monitor control data of the monitor controller 20-1 can be adaptively varied in response to display settings handled by the video card 10-3.

Figure 4:
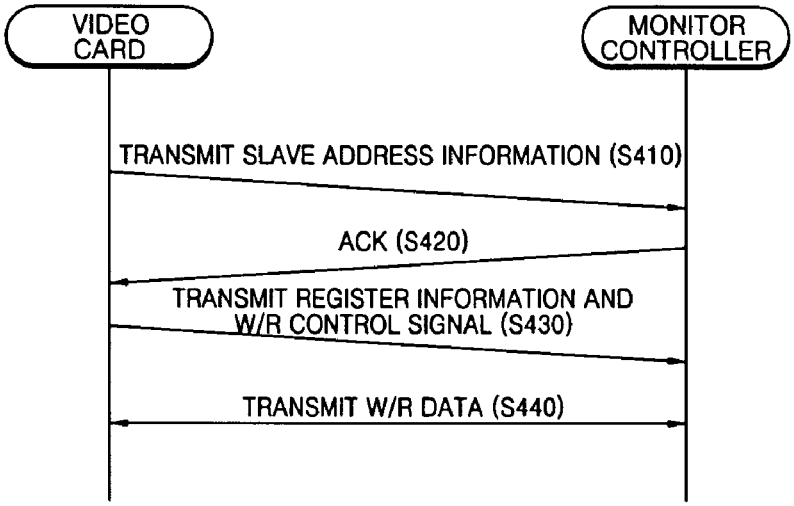
FIG. 4 shows data communication performed between a video card and a monitor controller in a multimedia system adopting the Display Data Channel transmission standard.

The method of data communication between the video card 10-3 and the monitor controller 20-1 according to the DDC communication protocol is described with reference to FIG. 4.

When a monitor control mode which corresponds to a condition that causes a function of the automatic display control is detected, the video card 10-3 transmits slave address information to the monitor controller 20-1 in operation S410.

In operation S420, the monitor controller 20-1 transmits an acknowledgement signal (ACK) to the video card 10-3 when receiving its own unique slave address information.

After the video card 10-3 receives the ACK from the monitor controller 20-1 in operation S430, the video card 10-3 transmits register information and a write/read (W/R) control signal to the monitor controller 20-1, and then, in operation S440, transmits/receives write/read data to/from the monitor controller 10-3.

According to the method described above, the video card 10-3 and the monitor controller 20-1 can perform data communication therebetween, and display settings of the monitor controller 20-1 can be varied in response to display settings of the video card 10-3.

Figure 5:
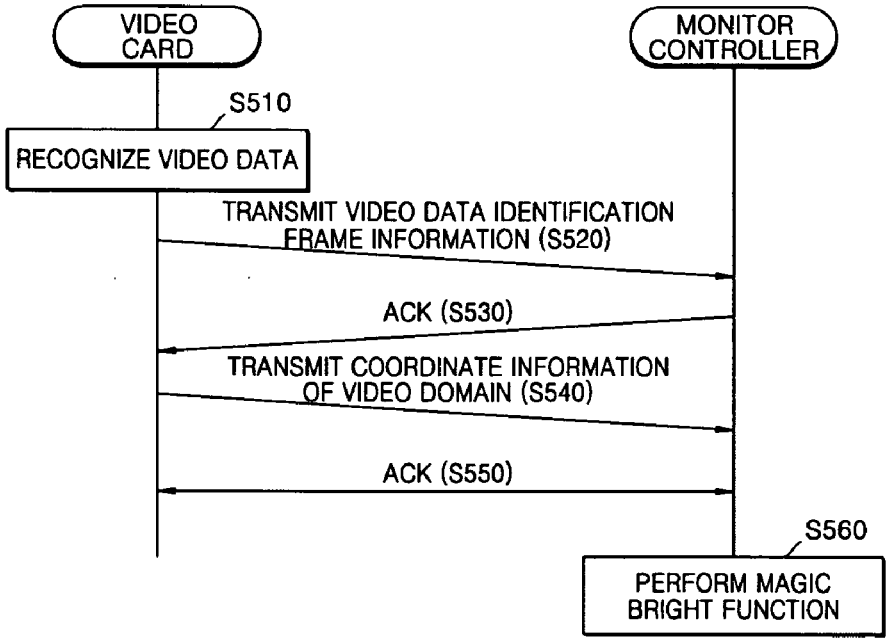
FIG. 5 shows data communication using an automatic magic bright function in a multimedia system.

Finally, a method of performing an automatic magic bright function, one of automatic display control functions, according to the DDC communication protocol between the video card 10-3 and the monitor controller 20-1, is described with reference to FIG. 5.

In operation S510, the video card 10-3 processes video data and graphic data, and identifies video data from the processed data.

If data processed by the video card 10-3 is video data, in operation S520, the video card 10-3 transmits video data identification frame information to the monitor controller 20-1.

After the monitor controller 20-1 receives the video data identification frame information from the video card 10-3 in operation S530, the monitor controller 20-1 transmits an acknowledgement signal (ACK) to the video card 10-3.

In operation S540, the video card 10-3 transmits to the monitor controller 20-1 coordinate information of the video domain in which video data is detected.

After the monitor controller 20-1 receives the coordinate information of the video domain, the monitor controller 20-1 transmits ACK to the video card 10-3, and then performs a magic bright function that controls the video signal processor 20-3 to increase the brightness level of video data included in the coordinate information of video domain.

Accordingly, the display settings of a monitor can be controlled to be adapted to the display settings of the video card 10-3.

As described above, the display settings of a display device in a multimedia system can be automatically varied in response to display control of a computer according to the embodiments of the present general inventive concept, so that a monitor can be controlled to be in an optimum state according to the display settings of a computer.

The present general inventive concept can be realized as a method, an apparatus, or a system. When the present general inventive concept is manifested in computer software, components of the present general inventive concept may be replaced with code segments that are necessary to perform the required operations.

The present general inventive concept can also be embodied as computer-readable code on a computer-readable medium. The computer-readable medium can include any data medium to contain computer-readable code. The computer-readable medium can also include a computer-readable recording medium. The computer-readable recording medium can be any data storage device that can store data which can be thereafter read by a computer system. Examples of the computer-readable recording medium include read-only memory (ROM), random-access memory (RAM), CD-ROMs, magnetic tapes, floppy disks, and optical data storage devices. The computer-readable recording medium can also be distributed over network coupled computer systems so that the computer-readable code is stored and executed in a distributed fashion. Functional programs, codes, and code segments to accomplish the present general inventive concept can be easily construed by programmers skilled in the art to which the present general inventive concept pertains.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A display device providing automatic display control, the display device comprising:

a memory that stores predetermined display information;

a controller that includes a communication module to perform data communication with an external device, selectively set to be in a master mode if the display device is determined to be in an initialize mode to write the display information to the memory and set to be in a slave mode if the memory contains previously stored display information to analyze display control data of a predetermined automatic display control function which is transmitted by the external device, in other modes, and generates a display control signal used to perform a function that corresponds to the result of analyzing the display control data; and a video signal processor that receives video signals from the external device, converts the format of the video signals to another format suitable for the display characteristics of a display, and processes the converted video signals according to the control signal.

2. The display device of claim 1, wherein the communication module includes hardware and software to implement a display data channel (DDC) transmission standard.

3. The display device of claim 1, wherein the display information includes display feature information and slave address information of the communication module.

4. The display device of claim 1, wherein the initialize mode is a mode in which the display device is booted for the first time since the display device has been manufactured.

5. The display device of claim 1, wherein the predetermined automatic display control function includes an automatic magic bright display function.

6. The display device of claim 1, wherein the memory stores a model name of the display device, and display device information including display device feature information, and wherein the display device feature information comprises resolutions supported by the display device and/or recommended by a manufacturer, and slave address information of the communication module.

7. The display device of claim 6, wherein the memory also stores various programs and data to control the display device.

8. A multimedia system providing automatic display control, the multimedia system comprising:

a computer which includes a first communication module that provides data communication with an external device, a video card, and software and hardware to drive the video card, reads display information from the external device according to a predetermined communication protocol, generates data in connection with an automatic display control function and transmits the data to the external device via the first communication module; and a display device, which includes a second communication module that provides data communication with the computer, selectively set to be in a master mode if the display device is determined to be in an initialize mode to write display information in a memory during the initialize mode and set to be in a slave mode if the memory contains previously stored display information, to analyze the data in connection with the automatic display control function that is transmitted by the computer, in other modes, and performs signal processing in response to the result obtained by analyzing the data in connection with the automatic display control function and outputs the processed signal.

9. The multimedia system of claim 8, wherein the first and second communication modules include hardware and software to implement a display data channel (DDC) transmission standard.

10. The multimedia system of claim 8, wherein the predetermined automatic display control function includes an automatic magic bright display function.

11. A multimedia system providing automatic display control, the multimedia system comprising:

a computer which includes a first communication module that provides data communication with an external device and reads display information from the external device according to a predetermined communication protocol, generates data in connection with an automatic display control function and transmits the data to the external device; and a display device including:

a memory which stores predetermined display information, a controller which includes a second communication module that performs data communication with the computer, selectively set to be in a master mode if the display device is determined to be in an initialize mode to write the display information in the memory during the initialize mode and set to be in a slave mode if the memory contains previously stored display information to analyze the data transmitted by the computer in connection with the automatic display control function, during other modes, and generates a display control signal to perform a function that is adaptable to the analyzed result, and a video signal processor which receives video signals from the computer, converts a format of the video signals to a format suitable for the display characteristics and processes the converted video signals according to the display control signal.

12. The multimedia system of claim 11, wherein the controller transmits an acknowledgment signal to the computer when receiving unique slave address information separate from the computer.

13. A multimedia system providing automatic display control, the multimedia system comprising:

a computer which provides data communication with an external device and reads display information from the external device according to a predetermined communication protocol, generates data in connection with an automatic display control function of the external device and transmits the data to the external device; and a display device including:

a memory which stores predetermined display information, a controller which performs data communication with the computer, selectively set to be in a master mode if the display device is determined to be in an initialize mode, to write the display information in the memory during the initialize mode and the controller is set to be in a slave mode, if the memory contains previously stored display information, to analyze the data transmitted by the computer in connection with the automatic display control function, during other modes, and generates a display control signal to perform a function that is adaptable to the analyzed result, and a video signal processor which receives video signals from the computer, converts a format of the video signals to a format suitable for the display characteristics and processes the converted video signals according to the display control signal.

14. An automatic display control method implemented in a display device of a multimedia system, the method comprising:

determining whether the display device is in an initialize mode;

if the display device is in an initialize mode, setting a display controller to be in a master mode;

determining whether predetermined display information is stored in a monitor memory; and if the predetermined display information is stored in the monitor memory, setting the display controller to be in a slave mode, and otherwise, setting the display controller to be in the slave mode after writing display information to the monitor memory.

15. The method of claim 14, wherein the initialize mode is a mode in which the display device is booted for the first time since the display device has been manufactured.

16. The method of claim 14, wherein the display information includes monitor feature information and slave address information of a communication module.

17. A non-transitory computer readable medium having embodied thereon a computer program to execute an automatic display control method that can be implemented in a display device of a multimedia system, the method comprising:

determining whether the display device is in an initialize mode;

setting a display controller to be in a master mode if the display device is in an initialize mode;

determining whether predetermined display information is stored in a display device memory; and setting the display controller to be in a slave mode if the predetermined display information is stored in the display device memory, and otherwise, setting the display controller to be in the slave mode after writing display information to the display memory.

* * * * *